US008398067B2

(12) United States Patent
Furuhashi et al.

(10) Patent No.: US 8,398,067 B2
(45) Date of Patent: Mar. 19, 2013

(54) SHEET PROCESSING APPARATUS AND IMAGE FORMING APPARATUS

(75) Inventors: Tomohiro Furuhashi, Kanagawa (JP); Keisuke Sugiyama, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/064,671

(22) Filed: Apr. 7, 2011

(65) Prior Publication Data

US 2011/0266738 A1 Nov. 3, 2011

(30) Foreign Application Priority Data

Apr. 28, 2010 (JP) ..... 2010-104285

(51) Int. Cl.
*B65H 37/04* (2006.01)

(52) U.S. Cl. ..... 270/58.11; 270/58.07; 270/58.08; 270/58.12; 270/58.17; 270/58.27

(58) Field of Classification Search ..... 270/37, 270/52.18, 58.07, 58.08, 58.09, 58.11, 58.12, 270/58.17, 58.27
See application file for complete search history.

(56) References Cited

U.S. PATENT DOCUMENTS

| | | | | |
|---|---|---|---|---|
| 4,988,085 | A * | 1/1991 | Maekawa et al. | 270/58.11 |
| 6,371,472 | B1 * | 4/2002 | Miyake et al. | 270/58.14 |
| 7,654,511 | B2 * | 2/2010 | Nagata et al. | 270/58.11 |
| 7,661,669 | B2 | 2/2010 | Ichihashi et al. | |
| 7,681,881 | B2 | 3/2010 | Kunieda et al. | |
| 7,798,480 | B2 | 9/2010 | Kikkawa et al. | |
| 2006/0202403 | A1 * | 9/2006 | Nagata et al. | 270/58.11 |
| 2009/0014949 | A1 | 1/2009 | Ichihashi et al. | |
| 2009/0066001 | A1 | 3/2009 | Ichihashi et al. | |
| 2010/0196074 | A1 * | 8/2010 | Tsuchihashi et al. | 399/407 |

FOREIGN PATENT DOCUMENTS

| | | | |
|---|---|---|---|
| JP | 2000177921 | A | 6/2000 |
| JP | 2010265067 | A | 11/2010 |

* cited by examiner

*Primary Examiner* — Leslie A Nicholson, III
(74) *Attorney, Agent, or Firm* — Harness, Dickey & Pierce, P.L.C.

(57) ABSTRACT

A sheet processing apparatus includes pairs of rollers being sheet conveying units that convey recording sheets that are sheet media, a binding tray in which a plurality of recording sheets conveyed by the pairs of rollers are stacked and the recording sheets are retained as a paper bundle, and a stapler being a binding unit that performs a binding process on the paper bundle retained in the binding tray. Target positions on the paper bundle are adjusted by moving both of two jogger fences in an R direction to move the paper bundle in the sheet width direction so as to displace the paper bundle with respect to the stapler.

6 Claims, 7 Drawing Sheets

SHEET PROCESSING APPARATUS AND IMAGE FORMING APPARATUS

CROSS-REFERENCE TO RELATED APPLICATIONS

The present application claims priority to and incorporates by reference the entire contents of Japanese Patent Application No. 2010-104285 filed in Japan on Apr. 28, 2010.

BACKGROUND OF THE INVENTION

1. Field of the Invention

The present invention relates to a sheet processing apparatus that performs a binding process on a plurality of stacked sheet media, such as paper sheets and overhead projector (OHP) sheets, and to an image forming apparatus, such as a printer, a copying machine, and a facsimile, having such a sheet processing apparatus.

2. Description of the Related Art

Conventionally, some known image forming apparatuses include a post-processing apparatus that performs a post-process such as a binding process on a recording medium that is a sheet medium, e.g., a recording sheet, after an image is formed thereon by an image forming unit.

Such a post-processing apparatus performs a binding process by stacking a plurality of sheet-like recording media into a sheet bundle, and by driving a staple through a target position on the sheet bundle using a stapler that is a binding unit. There are some demands for the post-processing apparatus to be able to adjust such a target position on a sheet bundle more freely in this binding process. For example, the size of a sheet bundle in a width direction, which is a direction perpendicular to the conveying direction of the sheet bundle (referred to as a width direction, hereinafter), differs depending on the size of the sheet medium and the orientation in which the sheet medium is conveyed. Therefore, for example, in the two-position binding in which staples are driven through two positions on the sheet bundle in the width direction, a certain staple pitch may be appropriate for a sheet bundle having a long size in the width direction, but may appear too wide if the binding process is performed on a sheet bundle having a shorter size in the width direction. In such a case, the post-processing apparatus is required to be able to adjust the target positions on the sheet bundle more freely, and to adjust the staple pitch used in the two-position binding depending on the size of the sheet bundle in the width direction.

As a structure for satisfying such a requirement, Japanese Patent Application Laid-open No. 2000-177921, for example, discloses a post-processing apparatus that can move a stapler to a desired position of the sheet bundle in the width direction. Such a post-processing apparatus can adjust a target position on the sheet bundle in the width direction in a desired manner, and adjust the staple pitch used in the two-position binding depending on the size of the sheet bundle in the width direction.

However, such a conventional post-processing apparatus adjusts a target position on the sheet bundle by moving the stapler while keeping the sheet bundle at a fixed position. Therefore, when a member other than the stapler is arranged at a desired target position on the sheet bundle, the stapler cannot perform the binding process at the target position. Therefore, positions that can be set as a target position are restricted. For example, in a post-processing apparatus in which the sheet bundle is aligned in the conveying direction by bringing the trailing edge of a sheet medium in the conveying direction into contact with a trailing edge reference fence, and in which a binding process is performed at a target position near the trailing edge of the sheet bundle, the binding process cannot be performed on the sheet bundle at a position that is brought into contact with the trailing edge reference fence.

In the explanation above, a sheet medium on which the binding process is performed by the sheet processing apparatus is explained to be a recording sheet. However, the sheet medium is not limited to a paper sheet such as a recording sheet, and the same problem will occur when other sheet media such as OHP sheets are bundled and the binding process is performed thereon.

Furthermore, in the explanation above, the sheet processing apparatus is explained to be a post-processing apparatus that performs a post-process such as binding process on a sheet medium having a surface on which an image is formed by the image forming apparatus. However, the sheet processing apparatus is not limited to a post-processing apparatus, and the same problem will occur in any sheet processing apparatus that performs a binding process on sheet media, such as a sheet processing apparatus that is independent from the image forming apparatus.

Furthermore, a stapler is generally used as a binding unit that performs a binding process on a sheet bundle. However, the same problem will occur in a binding unit other than a stapler, such as those used in a binding process using a clip or a thread.

SUMMARY OF THE INVENTION

It is an object of the present invention to at least partially solve the problems in the conventional technology.

In order to achieve the object, the present invention according to claim 1 provides a sheet processing apparatus. The sheet processing apparatus includes a sheet conveying unit that conveys a sheet medium, a sheet medium retaining unit in which a plurality of sheet media conveyed by the sheet conveying unit are stacked and the sheet media are retained as a sheet bundle, a binding unit that performs a binding process on the sheet bundle retained by the sheet medium retaining unit, and a sheet bundle moving unit that moves the sheet bundle so as to displace the sheet bundle with respect to the binding unit, wherein target positions on the sheet bundle are adjusted by displacing the sheet bundle with respect to the binding unit.

The present invention provides an image forming apparatus. The image forming apparatus includes, an image forming unit that forms an image on a sheet-like recording medium, and a post-processing unit that performs a post-process such as a binding process on the recording medium on which the image is formed by the image forming unit, wherein the post processing unit further includes, a sheet conveying unit that conveys a sheet medium, a sheet medium retaining unit in which a plurality of sheet media conveyed by the sheet conveying unit are stacked and the sheet media are retained as a sheet bundle, a binding unit that performs a binding process on the sheet bundle retained by the sheet medium retaining unit, and a sheet bundle moving unit that moves the sheet bundle so as to displace the sheet bundle with respect to the binding unit, wherein target positions on the sheet bundle are adjusted by displacing the sheet bundle with respect to the binding unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An exemplary embodiment of a sheet processing apparatus according to the present invention is described below.

Figure 2:
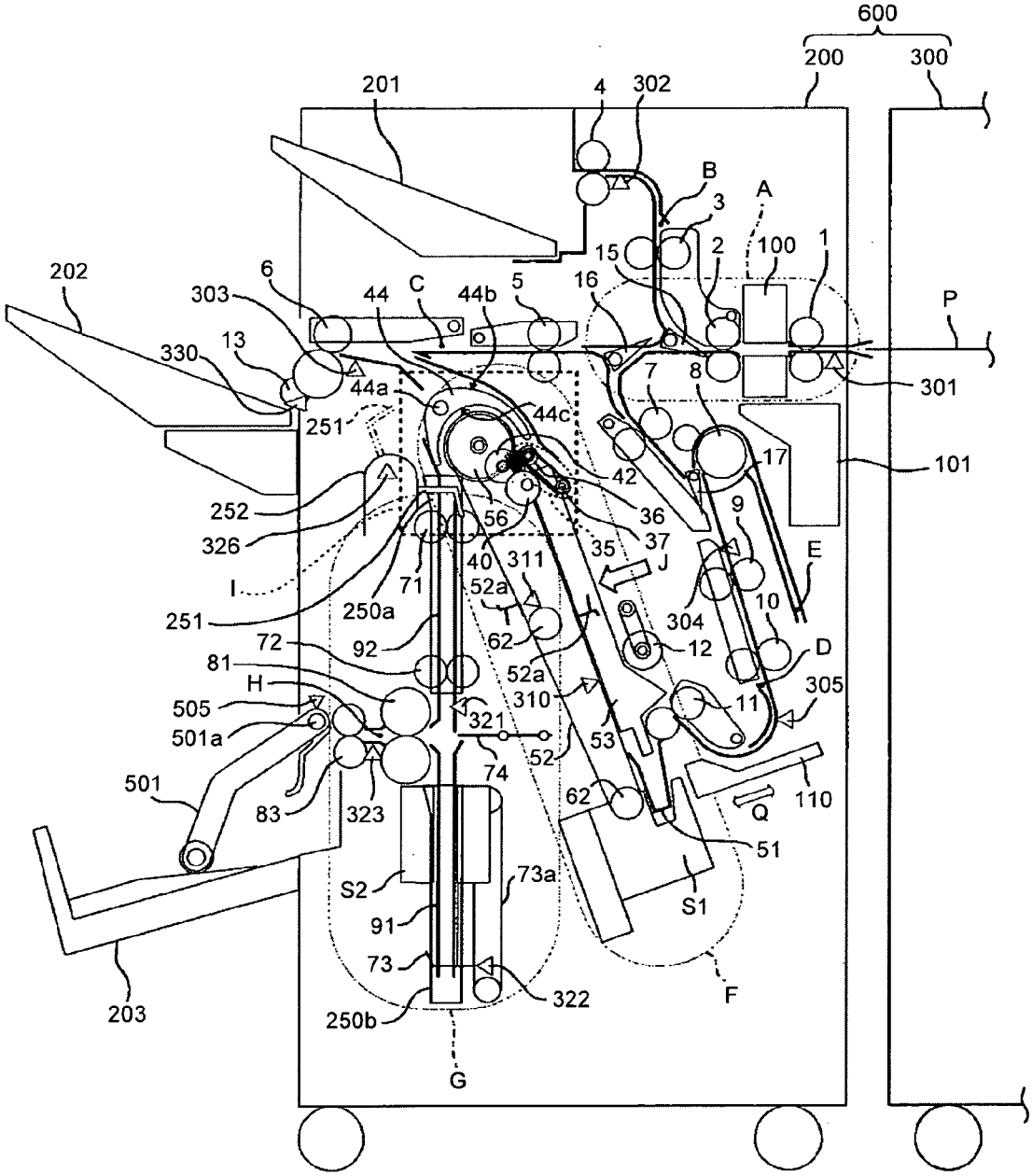
FIG. 2 is a schematic of an image forming apparatus according to an embodiment of the present invention.

FIG. 2 is a schematic of an image forming apparatus 600 including a post-processing unit 200 that is a sheet processing apparatus according to the embodiment, and an image forming unit 300, such as a copying machine and a printer, that supplies a recording sheet P that is a sheet medium after an image is formed to the post-processing unit 200.

The image forming unit 300 according to the embodiment is an electrophotographic image forming apparatus including an image processing circuit, a photosensitive element, an optical writing device, a developing unit, a transfer unit, and a fixing unit, although none of these are illustrated in particular. The image processing circuit converts image data read by a scanner unit if the image forming unit 300 is a copying machine, or image data received from an external apparatus, such as a personal computer, into printable image data, and outputs the converted image data to the optical writing device. The optical writing device performs optical writing on the photosensitive element based on the image signal received from the image processing circuit to form an electrostatic latent image on the surface of the photosensitive element. The developing unit develops the electrostatic latent image formed on the surface of the photosensitive element in the optical writing using a toner. The transfer unit transfers the toner image visualized on the surface of the photosensitive element by the developing unit onto a recording sheet P. The fixing unit fixes the toner image transferred to the recording sheet P onto the recording sheet P.

The recording sheet P on which the toner image is fixed in the image forming unit 300 is sent to the post-processing unit 200, and the post-processing unit 200 performs an intended post-process. As mentioned earlier, the image forming unit 300 according to the embodiment is an electrophotographic type. However, any known image forming apparatuses, such as inkjet or thermal transfer image forming apparatuses, may be combined with the post-processing unit 200 as the image forming unit 300.

As illustrated in FIG. 2, the post-processing unit 200 is attached to a side of the image forming unit 300, and the recording sheet P discharged from the image forming unit 300 is guided into the post-processing unit 200.

The post-processing unit 200 according to the embodiment can perform a punching process (a punching unit 100), a sheet aligning and edge binding process (jogger fences 53 and an edge binding stapler S1), a sheet aligning and center binding process (center binding unit upper jogger fences 250*a*, center binding unit lower jogger fences 250*b*, and a center binding stapler S2), a sheet sorting process (a shift tray 202), a center folding process (a folding plate 74 and a pair of folding rollers 81), and the like on the recording sheet P.

An entrance portion A in the post-processing unit 200 is a portion to which the recording sheet P discharged out of the image forming unit 300 is at first delivered, and includes a single sheet post-processing unit (in the embodiment, the punching unit 100 as a punching unit) that performs a post-process on each recording sheet P passing through the entrance portion A. A first discharging and conveying path B for guiding the recording sheet P into an upper tray 201 is arranged above the entrance portion A, and a second discharging and conveying path C for guiding the recording sheet P into a shift tray 202 is arranged on a side (the left side in FIG. 2) of the entrance portion A. A binding process conveying path D for guiding the recording sheet P into a binding tray F where aligning, stapling and the like are performed is arranged below the entrance portion A of the post-processing unit 200.

The entrance portion A is a conveying path located upstream of the first discharging and conveying path B, the second discharging and conveying path C, and the binding process conveying path D in the conveying direction, and forms a conveying path that is commonly used by every recording sheet P having passed from the image forming unit 300 to the post-processing unit 200. The entrance portion A has an entrance sensor 301 for detecting passage of a recording sheet P received from the image forming unit 300, and also has a pair of entrance rollers 1, the punching unit 100, a punch waste hopper 101, and a pair of pre-bifurcating carriage rollers 2 that are arranged sequentially at positions downstream of the entrance sensor 301. Two bifurcating claws, namely, a first bifurcating claw 15 and a second bifurcating claw 16, are arranged downstream of the pair of pre-bifurcating carriage rollers 2 in the entrance portion A.

The first bifurcating claw 15 and the second bifurcating claw 16 are kept at the positions illustrated in FIG. 2 by biasing members such as springs not illustrated. In other words, the first bifurcating claw 15 is biased so that the tip thereof is faced downwardly, and the second bifurcating claw 16 is biased so that the tip thereof is faced upwardly. Each of the first bifurcating claw 15 and the second bifurcating claw 16 is connected to a solenoid not illustrated, and the corresponding solenoids are turned ON to displace the tips of the first bifurcating claw 15 and the second bifurcating claw 16 from the positions illustrated in FIG. 2. In this manner, the conveying paths are switched for the recording sheet P passing through the positions where the bifurcating claws are disposed.

In the post-processing unit 200, the conveying path of the recording sheet P having passed through the entrance portion A is switched to one of the first discharging and conveying path B, the second discharging and conveying path C, and the binding process conveying path D by changing the combination of ON/OFF of the solenoids for the first bifurcating claw 15 and the second bifurcating claw 16.

When the recording sheet P having passed through the entrance portion A is to be guided into the first discharging and conveying path B, both of the solenoids for the first bifurcating claw 15 and the second bifurcating claw 16 are kept OFF so as to keep the first bifurcating claw 15 and the second bifurcating claw 16 in the arrangement illustrated in FIG. 2. By keeping the solenoid not illustrated and connected to the first bifurcating claw 15 OFF, the tip of the first bifurcating claw 15 is kept faced downwardly, thus enabling to guide the recording sheet P having passed through the pair of pre-bifurcating carriage rollers 2 to the first discharging and conveying path B. The recording sheet P guided into the first discharging and conveying path B is carried between a pair of carriage rollers 3 and a first pair of discharging rollers 4 disposed in the first discharging and conveying path B, and discharged onto the upper tray 201. As illustrated in FIG. 2, a first sheet-to-be-discharged detecting sensor 302 is disposed upstream of and near the first pair of discharging rollers 4 in the first discharging and conveying path B to detect the presence of a recording sheet P passing through the position of the first sheet-to-be-discharged detecting sensor 302.

When the recording sheet P having passed through the entrance portion A is to be guided into the binding process conveying path D, the solenoid corresponding to the first bifurcating claw 15 is turned ON, and the solenoid corresponding to the second bifurcating claw 16 is kept OFF. By means of these operations, the tip of the first bifurcating claw 15 is faced upwardly from the position faced downwardly illustrated in FIG. 2, and the tip of the second bifurcating claw 16 is kept faced upwardly in the manner illustrated in FIG. 2. In this manner, the first bifurcating claw 15 and the second bifurcating claw 16 can guide the recording sheet P having passed through the pair of pre-bifurcating carriage rollers 2 into the binding process conveying path D. The recording sheet P guided into the binding process conveying path D is conveyed into the binding tray F to be explained in detail later.

When the recording sheet P having passed through the entrance portion A is to be guided into the second discharging and conveying path C, the solenoids for both of the first bifurcating claw 15 and the second bifurcating claw 16 are turned ON. By means of these operations, the tip of the first bifurcating claw 15, faced downwardly in the initial position illustrated in FIG. 2, is faced upwardly, and the tip of the second bifurcating claw 16, faced upwardly in the initial position, is faced downwardly. In this manner, the first bifurcating claw 15 and the second bifurcating claw 16 can guide the recording sheet P having passed through the pair of pre-bifurcating carriage rollers 2 into the second discharging and conveying path C. The recording sheet P guided into the second discharging and conveying path C passes through a pair of carriage rollers 5 and a second pair of discharging rollers 6 disposed in the second discharging and conveying path C, and discharged onto the shift tray 202.

As illustrated in FIG. 2, a second sheet-to-be-discharged detecting sensor 303 is disposed upstream of and near the second pair of discharging rollers 6 included in the second discharging and conveying path C to detect the presence of a recording sheet P passing through the position of the second sheet-to-be-discharged detecting sensor 303.

A shift tray discharging unit including the shift tray 202 is arranged at the most downstream end of the conveying path of the recording sheet P passing through the entrance portion A and the second discharging and conveying path C in the post-processing unit 200. In addition to the shift tray 202, the shift tray discharging unit includes the second pair of discharging rollers 6, a reversing roller 13, and a shift tray paper surface detecting sensor 330. The shift tray discharging unit also includes a shifting mechanism, not illustrated, that moves the shift tray 202 reciprocally in the direction perpendicular to the conveying direction of the recording sheet P (sheet width direction), and shift tray elevating mechanism, not illustrated, that moves the shift tray 202 in the vertical directions.

A first pair of binding process conveying path rollers 7, a sheet guiding claw 17, a pre-stack sensor 304, a second pair of binding process conveying path rollers 9, a third pair of binding process conveying path rollers 10 and the like are arranged along the binding process conveying path D from the upstream side in the conveying direction. As illustrated in FIG. 2, the binding process conveying path D located downstream of the third pair of binding process conveying path rollers 10 is curved, and a curve entrance sheet detecting sensor 305 is disposed at the entrance of the curve to detect the presence of a recording sheet P passing through the position of the curve entrance sheet detecting sensor 305. A pair of binding process passing rollers 11 is disposed at an exit of the curve to pass the recording sheet P having passed through the binding process conveying path D to the binding tray F.

The sheet guiding claw 17 disposed in the binding process conveying path D is biased by a low-load spring not illustrated to the position illustrated in FIG. 2. In the configuration illustrated in FIG. 2, the sheet guiding claw 17 isolates the section having the first pair of binding process conveying path rollers 7 from the section having the second pair of binding process conveying path rollers 9 and the third pair of binding process conveying path rollers 10 in the binding process conveying path D. The recording sheet P conveyed by the first pair of binding process conveying path rollers 7 and the like is brought into contact with the sheet guiding claw 17, thereby causing the sheet guiding claw 17 to rotate in the counterclockwise direction in FIG. 2 against the biasing force of the low-load spring. In this manner, the recording sheet P is introduced into the section having the second pair of binding process conveying path rollers 9 and the third pair of binding process conveying path rollers 10 in the binding process conveying path D. As the trailing edge of the recording sheet P passes through the position where the sheet guiding claw 17 is disposed, the sheet guiding claw 17 returns to the position illustrated in FIG. 2 by the biasing force of the low-load spring.

In the post-processing unit 200, while the binding process is performed in the binding tray F, the next recording sheet P cannot be accepted into the binding tray F. At this time, if passing of the recording sheet P from the image forming unit 300 to the post-processing unit 200 is stopped so as not to supply a new recording sheet P into the binding tray F while the binding process is performed in the binding tray F, the productivity of the entire image forming apparatus 600 is reduced. To allow some time for the binding process to be completed while maintaining the productivity of the entire image forming apparatus 600, the post-processing unit 200 performs a so-called pre-stacking process in which a recording sheet P is temporarily accumulated, and a plurality of recording sheets P are simultaneously conveyed into the binding tray F to earn the substantial time.

In the structures of the post-processing unit 200, upon performing the pre-stacking process, at least the second pair of binding process conveying path rollers 9, amongst the three pairs of carriage rollers (9, 10 and 11) arranged downstream of the sheet guiding claw 17 included in the binding process conveying path D along the conveying direction, may be rotated in a reverse direction. Upon performing the pre-stacking process in which the recording sheet P is temporarily accumulated before being conveyed into the binding tray F, at least the second pair of binding process conveying path rollers 9 is rotated reversely after the trailing edge of the recording sheet P passes through the position where the sheet guiding claw 17 is disposed. At this time, because the conveying path leading to the section having the first pair of binding process conveying path rollers 7 is isolated by the sheet guiding claw 17, the recording sheet P conveyed by a pair of carriage rollers rotated in the reverse direction can be introduced into a pre-stacking unit E. Therefore, the recording sheet P can be conveyed along a turn guide 8 by rotating the pair of carriage rollers in the reverse direction after the trailing edge of the recording sheet P passes through the position where the sheet guiding claw 17 is disposed. In this manner, the recording sheet P can be guided from the trailing edge in the conveying direction into and accumulated (pre-stacked) in the pre-stacking unit E, so that the recording sheet P can be stacked and conveyed together with the next recording sheet P that is conveyed into the pre-stacking unit E into the binding tray F.

By repeating the process of rotating the pair of carriage rollers in the reverse direction after the trailing edge of the recording sheet P passes through the position where the sheet guiding claw 17 is disposed, two or more recording sheets P can be stacked and conveyed together into the binding tray F. The operational timing for rotating the pair of carriage rollers in the reverse direction is set later in time than the operational timing at which the pre-stack sensor 304 detects the trailing edge of the recording sheet P passing through the position where the sheet guiding claw 17 is disposed.

The recording sheet P having passed through the entrance portion A and the binding process conveying path D, guided into the binding tray F, and applied with a post-process such as aligning and stapling in the binding tray F is switched by a sheet bundle bifurcating guiding member 44 into one of the conveying path that leads to the shift tray 202 and the conveying path that leads to a lower tray 203.

When the recording sheet P is switched to the conveying path leading to the shift tray 202, the recording sheet P is guided upstream of and near the second sheet-to-be-discharged detecting sensor 303 in the second discharging and conveying path C, and discharged onto the shift tray 202 by the second pair of discharging rollers 6 in the same manner as the recording sheet P passing through the second discharging and conveying path C.

On the contrary, when the recording sheet P is switched to the conveying path leading to the lower tray 203, the recording sheet P is passed into a center binding/center folding unit G where processes such as a center folding process is applied to the recording sheet P, and the center binding/center folding unit G applies a post-process such as a center folding process to the recording sheet P using the folding plate 74 and the like. The recording sheet P applied with a post-process such as a center folding process passes through a post-center folding conveying path H, and is conveyed by a pair of lower discharging rollers 83 to the lower tray 203. As illustrated in FIG. 2, a lower sheet-to-be-discharged detecting sensor 323 is disposed upstream of and near the pair of lower discharging rollers 83 in the post-center folding conveying path H to detect the presence of the recording sheet P passing through the position where the lower sheet-to-be-discharged detecting sensor 323 is disposed.

The binding tray F will now be explained.

Figure 3:
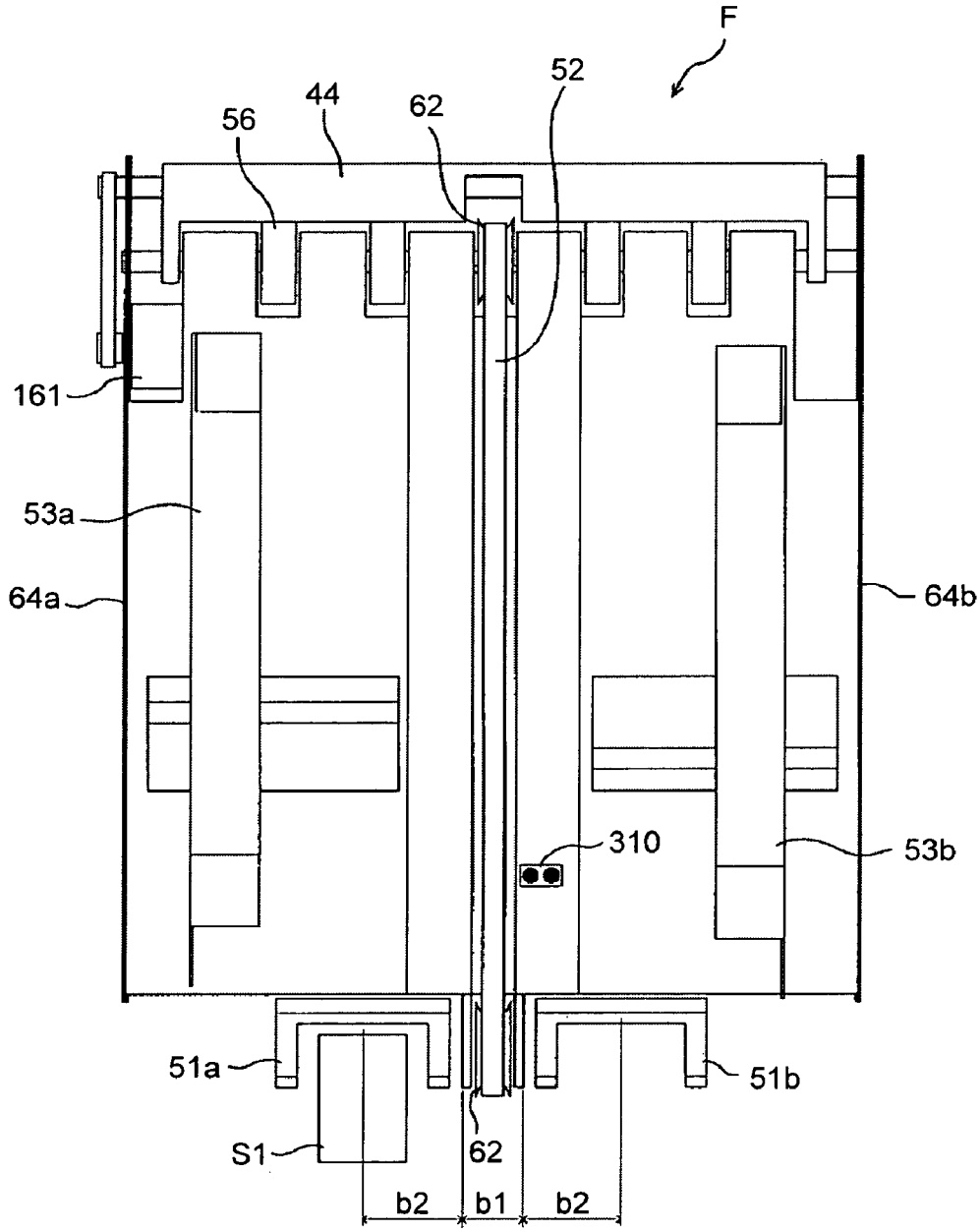
FIG. 3 is a schematic of the binding tray seen from the side of a stacking surface.
Figure 4:
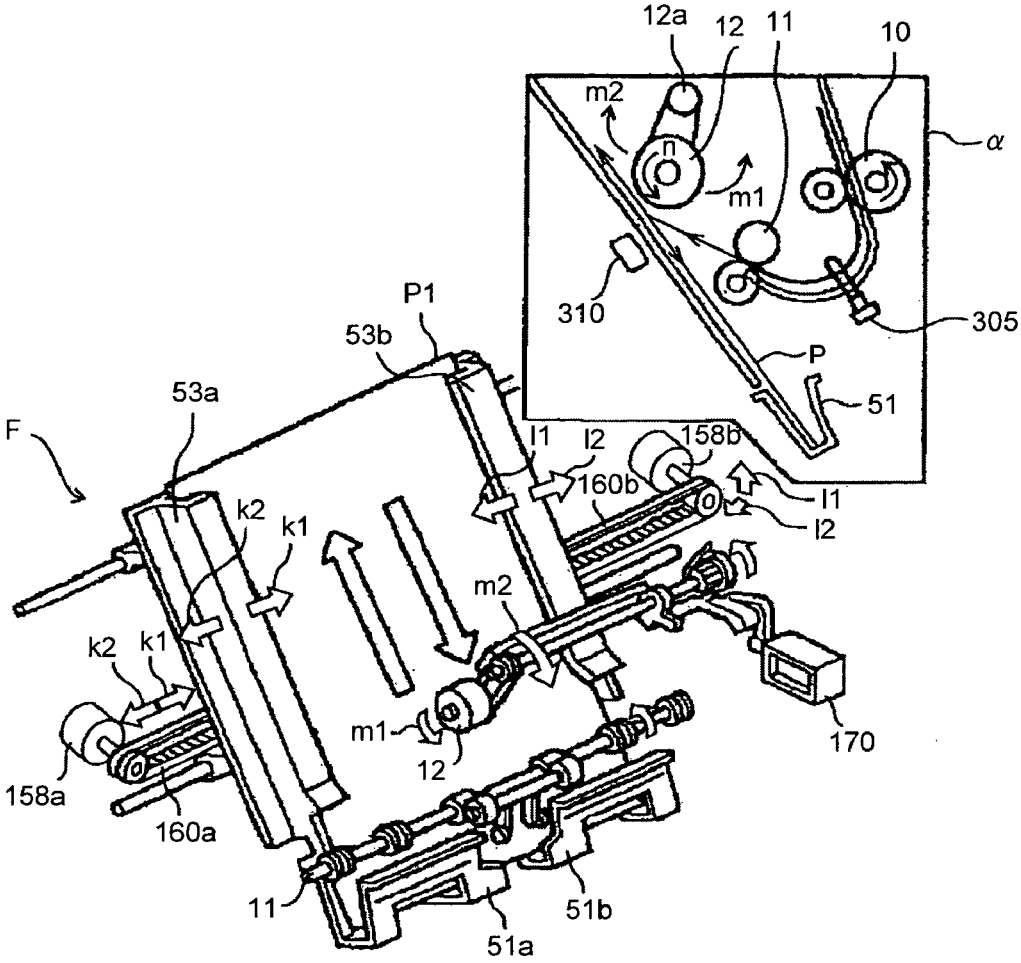
FIG. 4 is perspective view for explaining the binding tray and auxiliary mechanisms thereof.

FIG. 3 is a schematic of the binding tray F seen from the side of a stacking surface (from the direction indicated by the arrow J in FIG. 2). FIG. 4 is a perspective view of general structures of members included in the binding tray F and auxiliary mechanisms thereof. α in FIG. 4 is an enlarged side view of the binding tray F near a tapping roller 12. As illustrated in FIG. 3, a front plate 64*a* and a rear plate 64*b* are arranged on both sides of the binding tray F in the sheet width direction.

The recording sheet P guided into the binding tray F by the pair of binding process passing rollers 11 is sequentially stacked on the binding tray F as illustrated in FIG. 4. At this time, every time a recording sheet P is delivered into the binding tray F, the tapping roller 12 aligns the recording sheet P in the vertical direction (conveying direction), and jogger fences 53 (a front side jogger fence 53*a* and a rear side jogger fence 53*b*) align the recording sheet P in the lateral direction (the sheet width direction that is a direction perpendicular to the conveying direction).

Furthermore, as illustrated in FIGS. 2 to 4, the binding tray F includes a tray sheet detecting sensor 310 to detect the presence of a recording sheet P stacked on the binding tray F at the position where the tray sheet detecting sensor 310 is disposed.

A pendulum motion about a tapping fulcrum 12*a* is applied to the tapping roller 12 by a tapping solenoid 170, in the manner indicated by the arrow m1 and the arrow m2 in FIG. 4. The tapping roller 12 itself is rotated in the counterclockwise direction as indicated by the arrow n in FIG. 4. In this manner, the power to go forward generated by rotations of the tapping roller 12 acts on the recording sheet P sent into the binding tray F intermittently to bring the recording sheet P into contact with a trailing edge reference fence 51.

The jogger fence 53 is arranged in a pair (53*a* and 53*b*) in the sheet width direction as illustrated in FIGS. 3 and 4, and is driven to move reciprocally in the sheet width direction by jogger motors 158 that can also be rotated in a reverse direction via a timing belt 160.

The post-processing unit 200 also includes a front jogger motor 158*a* and a front timing belt 160*a*, and a rear jogger motor 158*b* and a rear timing belt 160*b*, for communicating driving forces to the front side jogger fence 53*a* and to the rear side jogger fence 53*b*, respectively. In this manner, each of the jogger fences 53 (53*a* and 53*b*) has an independent driving source (158*a* and 158*b*), and can be operated independently.

The reciprocal movements of each of the jogger fences 53 along the sheet width direction will now be explained.

When the length of the recording sheet P to be aligned in the sheet width direction is a sheet width W, the distance between the front side jogger fence 53*a* and the rear side jogger fence 53*b* in the sheet width direction is kept a little wider than the sheet width W in a standby condition, until the recording sheet P is received. When the recording sheet P is sent into the binding tray F and arrives between the two jogger fences 53, the front side jogger fence 53*a* is moved in the direction k1 in FIG. 4, and the rear side jogger fence 53*b* is moved in the direction 11 in FIG. 4. When the distance between the two jogger fences 53 in the sheet width direction reaches the sheet width W, the jogger motors 158 (158*a* and 158*b*) are rotated in the reverse directions to move the front side jogger fence 53*a* in the direction k2 in FIG. 4 and to move the rear side jogger fence 53*b* in the direction 12 in FIG. 4, until the distance between the two jogger fences 53 in the sheet width direction reaches the distance for the standby condition. By means of this control, the two jogger fences 53 are moved reciprocally, moving inwardly then moving outwardly simultaneously. Every time a recording sheet P is sent into the binding tray F, the reciprocating movement is performed one or more times so as to align a bundle of recording sheets P (also referred to as a paper bundle P1, hereinafter) stacked on the binding tray F in the sheet width direction.

In the embodiment, the two jogger fences 53 are moved reciprocally to align the paper bundle P1 in the sheet width direction. However, the operation of the jogger fences 53 performed to align the paper bundle P1 in the sheet width direction is not limited thereto. One of the two jogger fences 53 may be kept fixed, and only the other jogger fence 53 can be moved reciprocally in the sheet width direction.

The post-processing unit 200 includes a stapler S1 as a binding unit that performs a binding process on the trailing edge of the paper bundle P1 stacked on the binding tray F. The stapler S1 is configured to be movable in the sheet width direction of the paper bundle P1 that has been aligned. In the post-processing unit 200, the stapler S1 that is a binding unit is driven based on a staple signal issued by a control unit not illustrated during an intermission between jobs to apply the binding process to the paper bundle P1 after the aligning operation is completed. The intermission between jobs herein means a period between when a recording sheet P that is the last sheet in the paper bundle P1 stacked in the binding tray F arrives and when a recording sheet P that is the first sheet in the next paper bundle P1 arrives.

Figure 5:
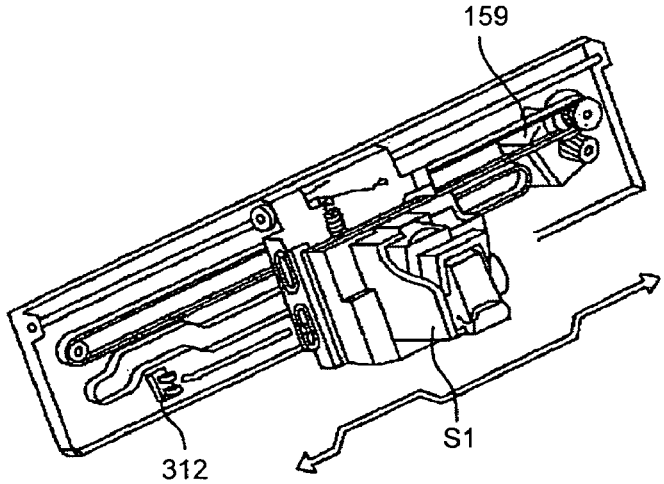
FIG. 5 is a perspective view for explaining a mechanism for moving a stapler.

FIG. 5 is a perspective view for explaining a mechanism for moving the stapler S1.

The stapler S1 is driven by a stapler moving motor 159, which can also be rotated in a reverse direction, via a stapler timing belt as illustrated in FIG. 5, and moved in the sheet width direction to a position for stapling a predetermined position of the trailing edge of the paper bundle P1 in the conveying direction. A stapler movement home position (HP) sensor 312 is disposed at one end of the movable range of the stapler S1 to detect the stapler S1 being at the home position, and movement to a target position in the sheet width direction is controlled using the moving amount of the stapler S1 from the home position.

A trailing edge holding lever 110 is disposed on the upper left side of the stapler S1 in FIG. 2. The trailing edge holding lever 110 is arranged facing the lower end of the trailing edge reference fence 51 so as to hold down the trailing edge of the paper bundle P1 held in the trailing edge reference fence 51, and can be moved reciprocally in the direction almost perpendicular to the stacking surface of the binding tray F, as indicated by the arrow Q in FIG. 2.

On the binding tray F, every time a recording sheet P arrives, the recording sheet P is aligned in the vertical direction (sheet conveying direction) using the tapping roller 12. However, if the trailing edge of the recording sheet P stacked on the binding tray F is curled or the recording sheet P is not very stiff, the trailing edge of the recording sheet P tends to be buckled and become bulged because of the weight of the recording sheet P itself. In addition, as the number of recording sheets P stacked on the binding tray F increases, the space through which the next recording sheet P is introduced into the trailing edge reference fence 51 becomes smaller, and alignment quality in the vertical direction tends to deteriorate. Therefore, the trailing edge holding lever 110 that is a trailing edge holding mechanism holding the recording sheet P directly is provided to reduce bulging of the trailing edge of the recording sheet P held in the binding tray F and to allow a new recording sheet P arriving at the binding tray F to enter the trailing edge reference fence 51 more easily.

The paper bundle P1 applied with the binding process is discharged to the shift tray 202 by a releasing belt 52. A discharging operation of the paper bundle P1 performed by the releasing belt 52 will now be explained.

Figure 6:
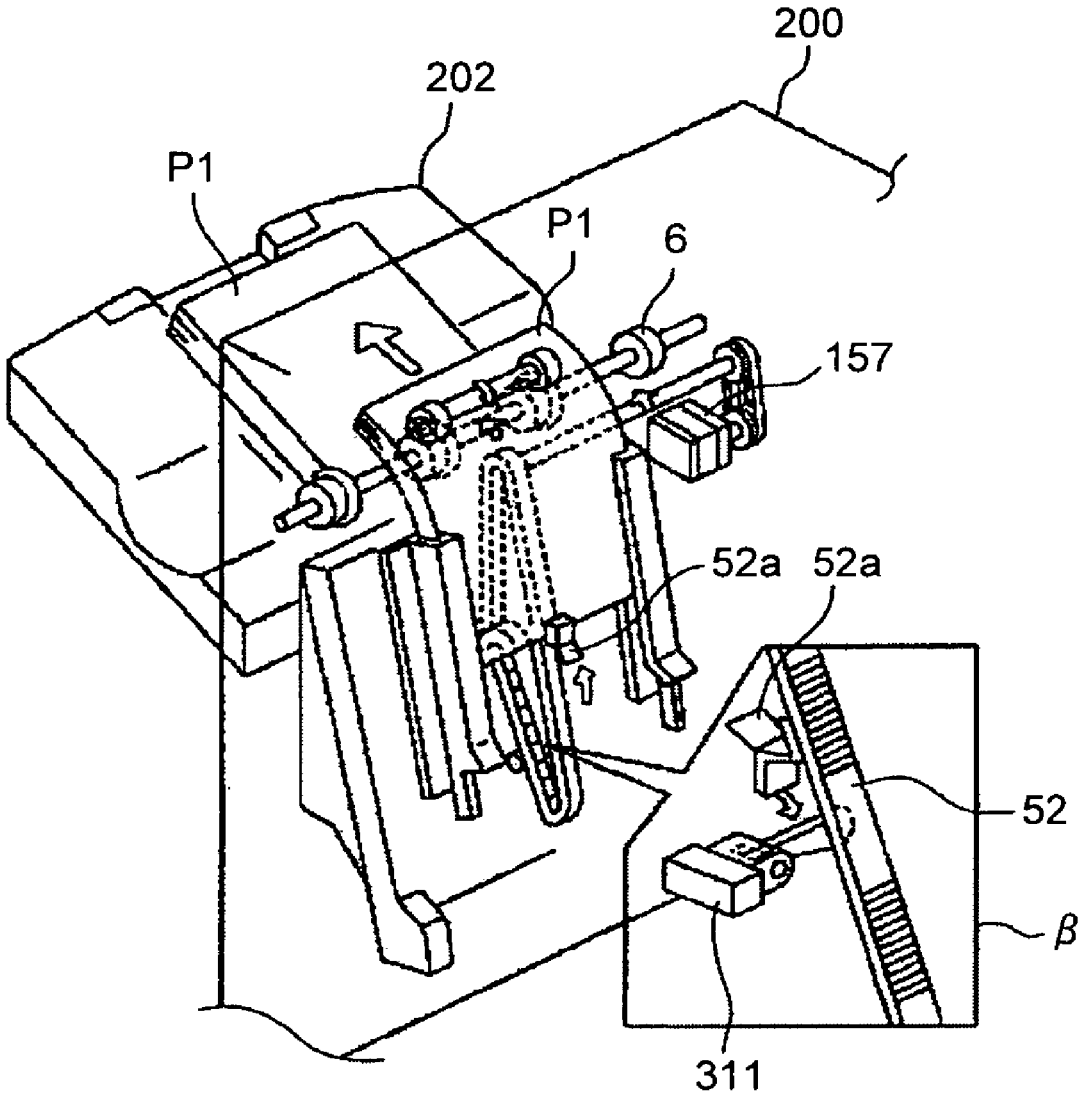
FIG. 6 is a perspective view for explaining a paper bundle discharging operation performed by a releasing belt.

FIG. 6 is a perspective view for explaining the discharging operation performed by the releasing belt 52. β in FIG. 6 is an enlarged perspective view of near a releasing belt HP sensor 311.

As illustrated in FIG. 3, the releasing belt 52 is positioned at the alignment center in the sheet width direction, and the releasing belt 52 is stretched across three pulleys 62, as illustrated in FIG. 2. A releasing motor 157 is driven to rotate the pulley 62 supporting the upper end of the releasing belt 52 and to communicate the driving force to the releasing belt 52, and the releasing belt 52 is caused to move endlessly.

A releasing claw 52*a* protruding out from the outer circumference of the releasing belt 52 is arranged on the releasing belt 52. The releasing motor 157 is driven to cause the releasing belt 52 to rotate in the counterclockwise direction in FIG. 2 so as to bring the releasing claw 52*a* into contact with the trailing edge (lower edge) of the paper bundle P1 applied with the binding process. The releasing belt 52 is then moved endlessly, so that the paper bundle P1 is lifted by the releasing claw 52*a*, and released out of the binding tray F.

Furthermore, as illustrated in FIGS. 2 and 3, a plurality of releasing rollers 56 are arranged across the releasing belt 52 symmetrically in the sheet width direction along the same axis as the pulleys 62 communicating the driving force to the releasing belt 52. The releasing rollers 56 are arranged rotatably about the driving shaft for communicating the driving force of the releasing motor 157 to the pulleys 62, and function as driven rollers when the paper bundle P1 is released.

The releasing operation of the paper bundle P1 from the binding tray F performed by the releasing belt 52 can be applied to a paper bundle that is not bound without application of the binding process after being aligned. The place to which the paper bundle P1 released from the binding tray F is conveyed is not limited to the shift tray 202, and the lower tray 203 may also be specified, as will be described later.

As illustrated in the enlarged view β in FIG. 6, the home position of the releasing claw 52*a* is detected by the releasing belt HP sensor 311, and the releasing belt HP sensor 311 is turned ON and OFF by the releasing claw 52*a* attached to the releasing belt 52. The releasing claw 52*a* is located at two locations of the external circumference of the releasing belt 52 in a manner equally dividing the circumferential length of the releasing belt 52, and these two releasing claws 52*a* move and convey the paper bundle P1 held in the binding tray F in an alternating manner.

As required, the releasing belt 52 may be rotated in the reverse direction, and the rear surface of the releasing claw 52*a* located on the opposite side of the releasing claw 52*a* waiting to move the paper bundle P1 may be used to align the leading edge of the paper bundle P1 held in the binding tray F in the conveying direction.

A sheet bundle conveying path switching unit I is arranged downstream of the binding tray F in the sheet conveying direction. The sheet bundle conveying path switching unit I has a structure for switching the conveying path of the paper bundle P1 released out of the binding tray F either to the conveying path for conveying the paper bundle P1 into the center binding/center folding unit G or to the conveying path for conveying the paper bundle P1 into the shift tray 202. The sheet bundle conveying path switching unit I includes a sheet bundle conveying mechanism 35 that applies the power to go forward to the paper bundle P1 lifted by the releasing claw 52*a*, the releasing rollers 56 that turn the paper bundle P1, and the sheet bundle bifurcating guiding member 44 that guides the turned paper bundle P1.

A structure of each of the members included in the sheet bundle conveying path switching unit I will now be explained. A driving force of a sheet bundle carriage driving shaft 37 is communicated to a sheet bundle carriage roller 36 in the sheet bundle conveying mechanism 35 via a sheet bundle carriage timing belt. The sheet bundle carriage roller 36 and the sheet bundle carriage driving shaft 37 are connected and supported by an arm, and the sheet bundle carriage roller 36 is rotatable about the sheet bundle carriage driving shaft 37 as a rotation fulcrum. A sheet bundle conveying member swinging cam 40 drives the sheet bundle carriage roller 36 included in the sheet bundle conveying mechanism 35 to swing, and the sheet bundle conveying member swinging cam 40 is swung about a swinging shaft by driving a motor not illustrated.

In the sheet bundle conveying mechanism 35, a sheet bundle carriage driven roller 42 is disposed at a position facing the sheet bundle carriage roller 36. The sheet bundle carriage driven roller 42 is pressed against the sheet bundle carriage roller 36 by an elastic member. The paper bundle P1 is nipped between the sheet bundle carriage driven roller 42 and the sheet bundle carriage roller 36, and power to go forward is applied to the paper bundle P1 by rotating the sheet bundle carriage roller 36 in the clockwise direction in FIG. 2.

The sheet bundle bifurcating guiding member 44 is supported rotatably about a bifurcating guide shaft 44*a*, and a driving force is communicated from a sheet bundle bifurcating guide driving motor 161 illustrated in FIG. 3 to rotate the sheet bundle bifurcating guiding member 44 about the bifurcating guide shaft 44*a*. Out of the surfaces of the sheet bundle bifurcating guiding member 44, the upper surface functions as a top guiding surface 44*b*, and the lower surface facing the releasing rollers 56 functions as a bottom guiding surface 44*c*.

To convey the paper bundle P1 from the binding tray F to the center binding/center folding unit G, the paper bundle P1 lifted by the releasing claw 52*a* is turned using the upper end of the releasing belt 52, and conveyed downwardly. The conveying path in which the paper bundle P1 is turned downwardly is formed between the upper surface of the releasing rollers 56 and the bottom guiding surface 44*c* of the sheet bundle bifurcating guiding member 44.

To convey the paper bundle P1 from the binding tray F to the shift tray 202, the sheet bundle bifurcating guiding member 44 is rotated about the bifurcating guide shaft 44*a* in the clockwise direction in FIG. 2. The space between the top guiding surface 44*b* of the sheet bundle bifurcating guiding member 44 and a guide plate facing the top guiding surface 44*b* functions as a conveying path.

To send the paper bundle P1 from the binding tray F to the center binding/center folding unit G, the trailing edge of the paper bundle P1 aligned in the binding tray F is pushed up by the releasing claw 52*a*, and the paper bundle P1 is nipped between the sheet bundle carriage roller 36 of the sheet bundle conveying mechanism 35 and the sheet bundle carriage driven roller 42 so as to apply the power to go forward to the paper bundle P1. At the operational timing at which the leading edge of the paper bundle P1 pushed up by the releasing claw 52*a* passes through the position where the paper bundle P1 is nipped between the sheet bundle carriage roller 36 and the sheet bundle carriage driven roller 42, the sheet bundle carriage roller 36 is kept standby at a position where the sheet bundle carriage roller 36 does not collide with the leading edge of the paper bundle P1.

After the leading edge of the paper bundle P1 passes through the position where the paper bundle P1 is nipped between the sheet bundle carriage roller 36 and the sheet bundle carriage driven roller 42, the sheet bundle carriage roller 36 is brought into contact with the surface of the paper bundle P1 to apply the power to go forward, which is generated by a rotation of the sheet bundle carriage roller 36, to the paper bundle P1. The paper bundle P1 applied with the power to go forward by the sheet bundle carriage roller 36 passes through a turning conveying path formed between the upper surface of the releasing rollers 56 and the bottom guiding surface 44*c* of the sheet bundle bifurcating guiding member 44, and is conveyed into the center binding/center folding unit G.

The center binding/center folding unit G is arranged downstream of the sheet bundle conveying path switching unit I in the sheet conveying direction, as illustrated in FIG. 2. The center binding/center folding unit G is arranged so that the conveying path of the paper bundle P1 conveyed from the sheet bundle conveying path switching unit I becomes almost vertical, and a center folding mechanism including the folding plate 74 is disposed at the center of the conveying path in the vertical direction. A center binding unit upper paper bundle conveying guide plate 92 is arranged in the upper portion of the center folding mechanism, and a center binding unit lower paper bundle conveying guide plate 91 is arranged in the lower portion of the center folding mechanism.

A pair of center binding unit upper paper bundle carriage rollers 71 is arranged at the upper area of the center binding unit upper paper bundle conveying guide plate 92, and a pair of center binding unit lower paper bundle carriage rollers 72 is arranged at the lower area of the center binding unit upper paper bundle conveying guide plate 92. Center binding unit upper jogger fences 250*a* are arranged in a manner striding over the pair of center binding unit upper paper bundle carriage rollers 71 and the pair of center binding unit lower paper bundle carriage rollers 72, along both sides of the center binding unit upper paper bundle conveying guide plate 92 in the sheet width direction. Similarly, center binding unit lower jogger fences 250*b* are arranged along the both sides of the center binding unit lower paper bundle conveying guide plate 91 in the sheet width direction.

The center binding stapler S2 is disposed at the position where the center binding unit lower jogger fences 250*b* are installed.

The center binding unit upper jogger fences 250*a* and the center binding unit lower jogger fences 250*b* are driven by a driving mechanism not illustrated to align the paper bundle P1 held in the center binding/center folding unit G along the sheet width direction. As the center binding stapler S2, a clincher and a driver are disposed across the conveying path formed by the center binding unit lower paper bundle conveying guide plate 91 in pairs, and two pairs of the clincher and the driver are arranged with a predetermined space therebetween in the sheet width direction.

A center binding unit movable leading edge fence 73 is laid across the center binding unit lower paper bundle conveying guide plate 91. The center binding unit movable leading edge fence 73 is configured to be movable in the sheet conveying direction (the vertical directions in FIG. 2) by a driving mechanism including a leading edge fence timing belt 73*a* and driven by a driving source not illustrated.

The driving mechanism for the center binding unit movable leading edge fence 73 includes, as illustrated in FIG. 2, a driving pulley and a driven pulley across which the leading edge fence timing belt 73*a* is stretched, and a stepping motor that is a driving source not illustrated for driving the driving pulley. A leading edge fence HP sensor 322 is arranged at the lower part of the leading edge fence timing belt 73*a* to detect the home position of the center binding unit movable leading edge fence 73.

A trailing edge tapping claw 251 and a driving mechanism for the trailing edge tapping claw 251 are arranged at the top of the center binding unit upper paper bundle conveying guide plate 92. The trailing edge tapping claw 251 is configured to be movable by a driving mechanism including a trailing edge tapping claw timing belt 252 driven by a driving source not illustrated in a direction to be brought into contact with the trailing edge of the paper bundle P1 stacked on the center binding/center folding unit G and in a direction moving away from the trailing edge of the paper bundle P1 in a reciprocating manner.

In FIG. 2, only an upper part of the trailing edge tapping claw timing belt 252 is illustrated. However, the trailing edge tapping claw timing belt 252 is a loop-like endless belt in the same manner as any other timing belts. Furthermore, as illustrated in FIG. 2, a trailing edge tapping claw HP sensor 326 is arranged inside of the upper part of the trailing edge tapping claw timing belt 252 to detect the home position of the trailing edge tapping claw 251. The home position of the trailing edge tapping claw 251 is the position illustrated in the long dashed double-short dashed line in FIG. 2, and the trailing edge tapping claw 251 is brought to the home position at an operational timing when the paper bundle P1 is conveyed from the binding tray F into the center binding/center folding unit G. After the leading edge of the paper bundle P1 conveyed into the center binding/center folding unit G is brought into contact with the center binding unit movable leading edge fence 73, the trailing edge tapping claw timing belt 252 is driven to bring the trailing edge tapping claw 251 into contact with the trailing edge of the paper bundle P1, so that the paper bundle P1 is aligned in the sheet conveying direction.

The center folding mechanism is arranged almost at the center of the center binding/center folding unit G, and includes the folding plate 74, the pair of folding rollers 81, and the post-center folding conveying path H for conveying the paper bundle E1 folded at the center. The lower sheet-to-be-discharged detecting sensor 323 is arranged along the post-center folding conveying path H to detect passage of the paper bundle P1 folded at the center. A folding unit arrival sensor 321 is arranged above the folding plate 74 to detect the paper bundle P1 arriving at the center folding position.

The post-processing unit 200 includes a height detecting lever 501 for detecting the height of the stacked paper bundle P1 discharged onto the lower tray 203 after passing through the post-center folding conveying path H. The height detecting lever 501 is arranged in a swingable manner about a lever fulcrum 501*a* as a swinging axis. A lower tray paper surface sensor 505 detects a change in the angle of the height detecting lever 501, and the detection result is used in controlling elevating and lowering operations of the lower tray 203 and detecting overflow.

Characterizing portions of the post-processing unit 200 according to the embodiment will now be explained.

As mentioned above, a recording sheet P guided into the binding tray F is stacked one by one, and the tapping roller 12 aligns the recording sheet P in the vertical direction (sheet conveying direction) and the jogger fences 53 align the recording sheet P in the lateral direction (sheet width direction). After the predetermined number of recording sheets P is stacked, the stapler S1 performs the binding process on the aligned paper bundle P1. In the embodiment, an example of performing two-position binding in which staples are driven through two positions of the trailing edge of the paper bundle P1 in the sheet width direction will be explained.

As illustrated in FIG. 3, the binding tray F includes the two jogger fences 53, which are the front side jogger fence 53*a* and the rear side jogger fence 53*b*, as an aligning unit that aligns the paper bundle P1 in the sheet width direction. The end of the paper bundle P1 coming to the front side in FIG. 2 is aligned by the front side jogger fence 53*a*, and the end of the paper bundle P1 coming to the rear side in FIG. 2 is aligned by the rear side jogger fence 53*b*. As mentioned earlier, these two jogger fences 53 have corresponding independent driving sources (158*a* and 158*b*), and can be moved independently.

Furthermore, the tapping roller 12 brings the trailing edge of the paper bundle P1 into contact with the two trailing edge reference fences 51, namely, a front side trailing edge reference fence 51*a* and a rear side trailing edge reference fence 51*b*, to align the paper bundle P1 in the sheet conveying direction.

The stapler S1 performs the binding process on the paper bundle P1 after a predetermined number of recording sheets P is stacked and aligned in the sheet conveying direction and the sheet width direction. As illustrated in FIGS. 3 and 4, the two trailing edge reference fences 51 (51*a* and 51*b*) have a shape escaped from the stapler S1 being in a clinching operation so as not to interrupt the clinching operation of the stapler S1 (staple driving operation). The trailing edge reference fences 51 are configured to be movable with the stapler S1 in the sheet width directions (horizontal directions in FIG. 3) while maintaining a relative positional relationship with the stapler S1, as illustrated in FIG. 3.

The stapler S1 is freely movable from the front side to the rear side between the front plate 64*a* and the rear plate 64*b*. On the contrary, the front side trailing edge reference fence 51*a*, which is one of the two trailing edge reference fences 51, is movable only in the range toward the front side in the sheet width direction from the releasing belt 52 disposed at the center of the alignment (the range between the releasing belt 52 and the front plate 64*a*). The rear side trailing edge reference fence 51*b* is movable only in the range toward the rear side from the releasing belt 52 (the range between the releasing belt 52 and the rear plate 64*b*). Because the releasing belt 52 is present, the front side trailing edge reference fence 51*a* and the rear side trailing edge reference fence 51*b* cannot be moved toward any further inside from the positions illustrated in FIG. 3. Therefore, the stapler S1 cannot perform the clinching operation at a position located more inner than those illustrated in FIG. 3. The minimum staple pitch in the two-position binding is thus limited.

Figure 7:
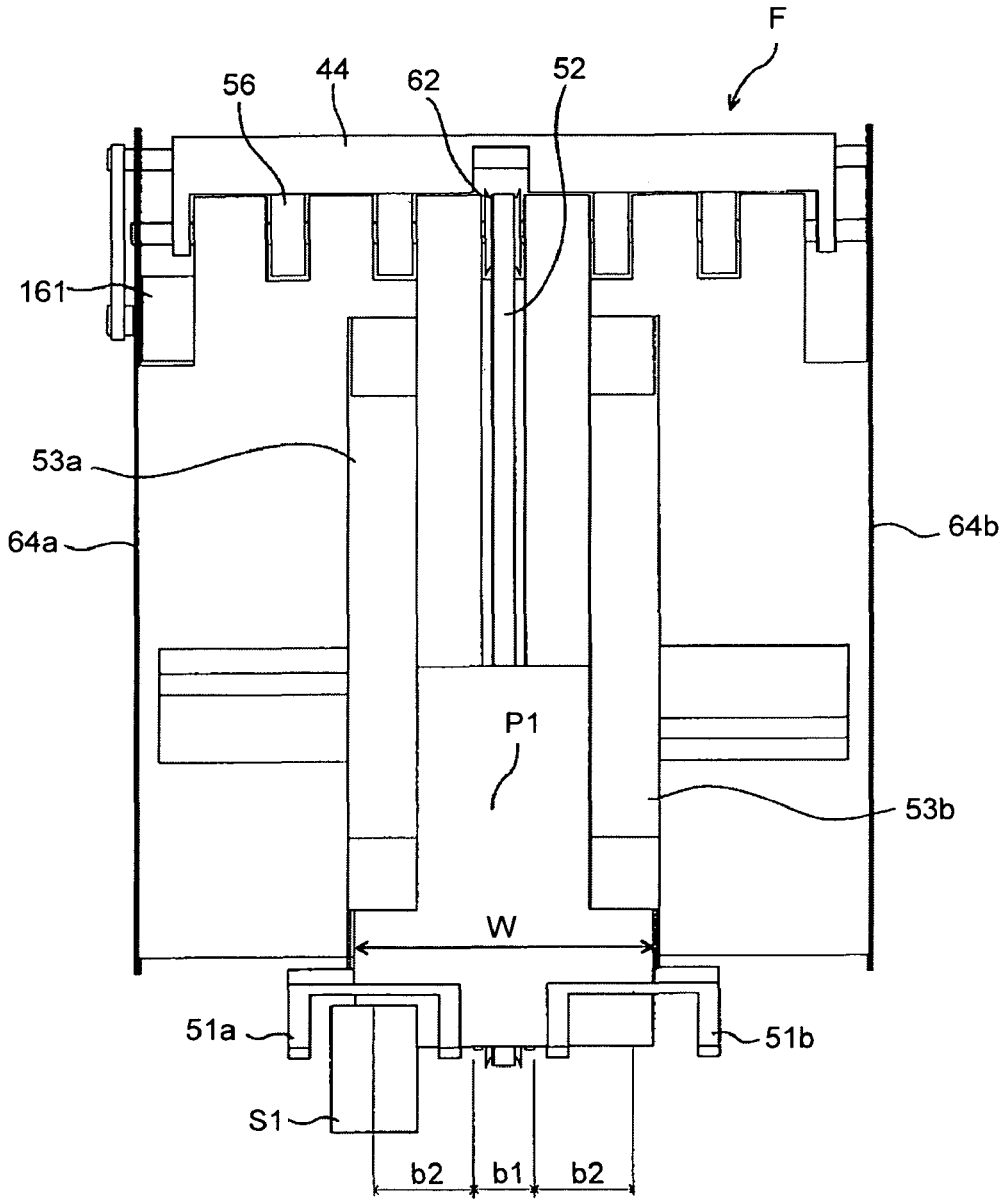
FIG. 7 is a schematic for explaining the binding tray when a small-sized paper bundle is stacked.

FIG. 7 is a schematic for explaining the binding tray F illustrated in FIG. 3 when a paper bundle P1 of small-sized recording sheets P is stacked and aligned.

In this example, as illustrated in FIG. 7, the width of the structure including the releasing belt 52 located at the center of the alignment in the sheet width direction in FIG. 2 is denoted as b1, and the distance between the edge of the trailing edge reference fence 51 and a position where a clinching operation can be performed is denoted as b2. If the binding process is to be performed only by moving the stapler S1 and the trailing edge reference fence 51, the binding process cannot be performed in the range b1+b2×2 near the center of the paper bundle P1. Therefore, upon performing the two-position binding, the minimum staple pitch will be b1+b2×2 when the paper bundle P1 is not moved.

If there is such a range near the center of the paper bundle P1 where the binding process cannot be performed, and two-position binding is performed on the small-sized paper bundle P1 illustrated in FIG. 7, the staples will be driven through relatively outer positions compared with those driven through a paper bundle P1 of a larger size, and resultant appearance will not be very nice.

As a structure that can address this issue, the post-processing unit 200 according to the embodiment includes a structure in which the two jogger fences 53 (53*a* and 53*b*) are moved in the same direction along the sheet width direction after the paper bundle P1 is aligned.

Figure 1:
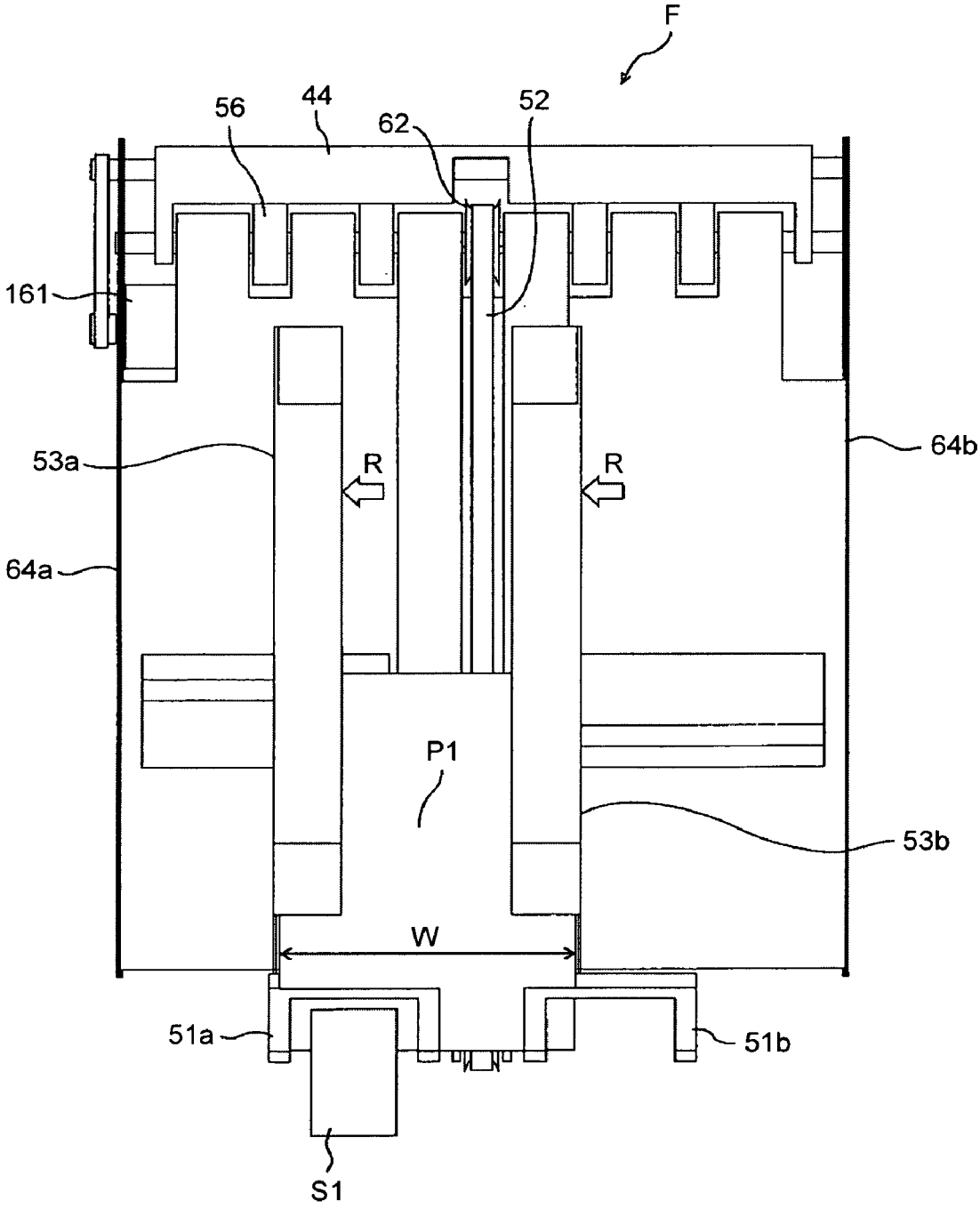
FIG. 1 is a schematic for explaining how a paper bundle is moved by a binding tray in a post-processing apparatus.

FIG. 1 is a schematic for explaining the two jogger fences 53 (53*a* and 53*b*) moved in the same direction along the sheet width direction with respect to the binding tray F illustrated in FIG. 7.

In the post-processing unit 200 according to the embodiment, even upon performing alignment on the small-sized paper bundle P1, the two jogger fences 53 performs the reciprocal movement one or more times similarly to the control explained above, every time a recording sheet P is sent into the binding tray F. In this manner, the paper bundle P1 in the binding tray F is aligned in the sheet width direction.

When the number of recording sheets P becomes the predetermine number for performing the binding process on the paper bundle P1, each of the jogger fences 53 is moved to make the distance between the two jogger fences 53 (53*a* and 53*b*) in the sheet width direction the sheet width W of the paper bundle P1 (the arrangement illustrated in FIG. 7).

The two jogger fences 53 are then moved by the same distance toward the front side as indicated by the arrows R in FIG. 1. In this manner, the paper bundle P1 held between the two jogger fences 53 is carried forward. Therefore, the stapler S1 can drive staples through a position near the center of the paper bundle P1 where a staple could not be driven through in the binding process in which only the stapler S1 and the trailing edge reference fence 51 are moved.

As explained above, by moving the two jogger fences 53 by the same distance and in the same direction after aligning the paper bundle P1, the paper bundle P1 can be moved relatively with respect to the stapler S1. In this manner, the binding process can be performed on any position on a small-sized paper bundle P1. The paper bundle P1 may be moved to a predetermined position only by using the two jogger fences 53. Alternatively, the stapler S1 as well as the jogger fences 53 may be moved.

To perform a binding process at a target position closer to the front side near the center in two-position binding, the rear side jogger fence 53*b* is moved closer to the front side than the rear side trailing edge reference fence 51*b* as illustrated in FIG. 1, so that the paper bundle P1 is moved closer to the front side than the rear side trailing edge reference fence 51*b*. To perform a binding process at a target position closer to the rear side near the center in the two-position binding, the front side jogger fence 53*a* is moved closer to the rear side than the front side trailing edge reference fence 51*a*, so that the paper bundle P1 is moved closer to the rear side than the front side trailing edge reference fence 51*a*. In this manner, a binding process can be performed in the area b1+b2×2 near the center of the paper bundle P1.

By enabling the binding process to be performed in the area near the center, the issue of bad appearance upon performing the two-position binding on a small-sized paper bundle P1 can be addressed.

In a conventional structure where the positions for performing the binding process are adjusted only by moving the stapler and the trailing edge reference fence, if there is any member that prevents a clinching operation from being performed at a desired target position on a sheet bundle, such a member must be moved away. For example, if a trailing edge reference fence for supporting the alignment center of the sheet bundle is present, in addition to the trailing edge reference fence that is moved correspondingly to the target position along the sheet width direction, the binding process cannot be performed on the position where the trailing edge reference fence is arranged, which is at the alignment center. Therefore, a new mechanism for moving the trailing edge reference fence away will be required. If a new mechanism is added, the structure could become more complex, and the costs could increase as well.

On the contrary, such a new mechanism is not required in the structure where the target position on the paper bundle P1 is adjusted by moving the two jogger fences 53 in the same direction so as to move the position of the paper bundle P1 with respect to the stapler S1, like the post-processing unit 200 according to the embodiment. This is because the target position can be adjusted using the mechanism for moving the jogger fences 53 used for the purpose of aligning the paper bundle P1 in the sheet width direction. Because such a structure requires only addition of new control for causing the jogger fences 53, which are moved in opposing directions in the aligning operation, e.g., toward the inner side and the outer side, respectively, to move in the same direction after the aligning operation, the structure can be prevented from being complex and increasing the cost, in comparison with the structure in which a new mechanism is added to adjust the target position.

In this manner, in the structure of the post-processing unit 200 according to the embodiment performing the two-position binding, the binding process can be performed at any position along the trailing edge of paper bundle P1 in the sheet width direction without making the structure complex, and the freedom in target positions can be increased.

Like the post-processing unit 200, a structure that adjusts the target positions on the paper bundle P1 by moving the aligned paper bundle P1 can increase the freedom in target positions. Such a structure can also alleviate reduced productivity of a post-process caused by the binding process when the movement of the jogger fences 53 and the movement of the stapler S1 are further combined.

In the conventional structure where the positions for performing the binding process are adjusted only by moving the stapler and the trailing edge reference fence, the stapler must be moved after applying the binding process at the first target position to the second target position in the two-position binding by a distance equivalent to a staple pitch in the two-position binding. Therefore, if the staple pitch is wide, the time required in moving the stapler will also be extended. At this time, if a structure optimizes the processing time by adjusting the sheet interval between the last sheet medium in the sheet bundle that is previously applied with the post-process and the first sheet medium in the next sheet bundle that will be applied with the post-process in a manner corresponding to a staple pitch, the sheet interval must be increased when the staple pitch is wide. Therefore, the productivity will be reduced.

On the contrary, in the structure that adjusts the target positions on the paper bundle P1 by moving the paper bundle P1, it is only necessary for the sum of the moving distance of the stapler S1 and the moving distance of the paper bundle P1 to be equal to the staple pitch. Therefore, the moving distance of the stapler S1 can be reduced compared with the structure where only the stapler is moved. By reducing the moving distance of the stapler S1, the time required in moving the stapler S1 can be reduced, and the sheet interval can also be reduced. Therefore, the reduced productivity of the post-process caused by the binding process can be alleviated.

If the paper bundle P1 is moved by moving the jogger fences 53 in the sheet width direction, the center of the paper bundle P1 in the sheet width direction upon performing the binding process will be offset from the position where the releasing claw 52*a* is brought into contact. Therefore, the position at which the releasing claw 52*a* pushes up the paper bundle P1 becomes offset from the center of the paper bundle P1. However, because the two jogger fences 53 support both ends of the paper bundle P1 in the sheet width direction, the paper bundle P1 is discharged without being tilted.

Figure 8:
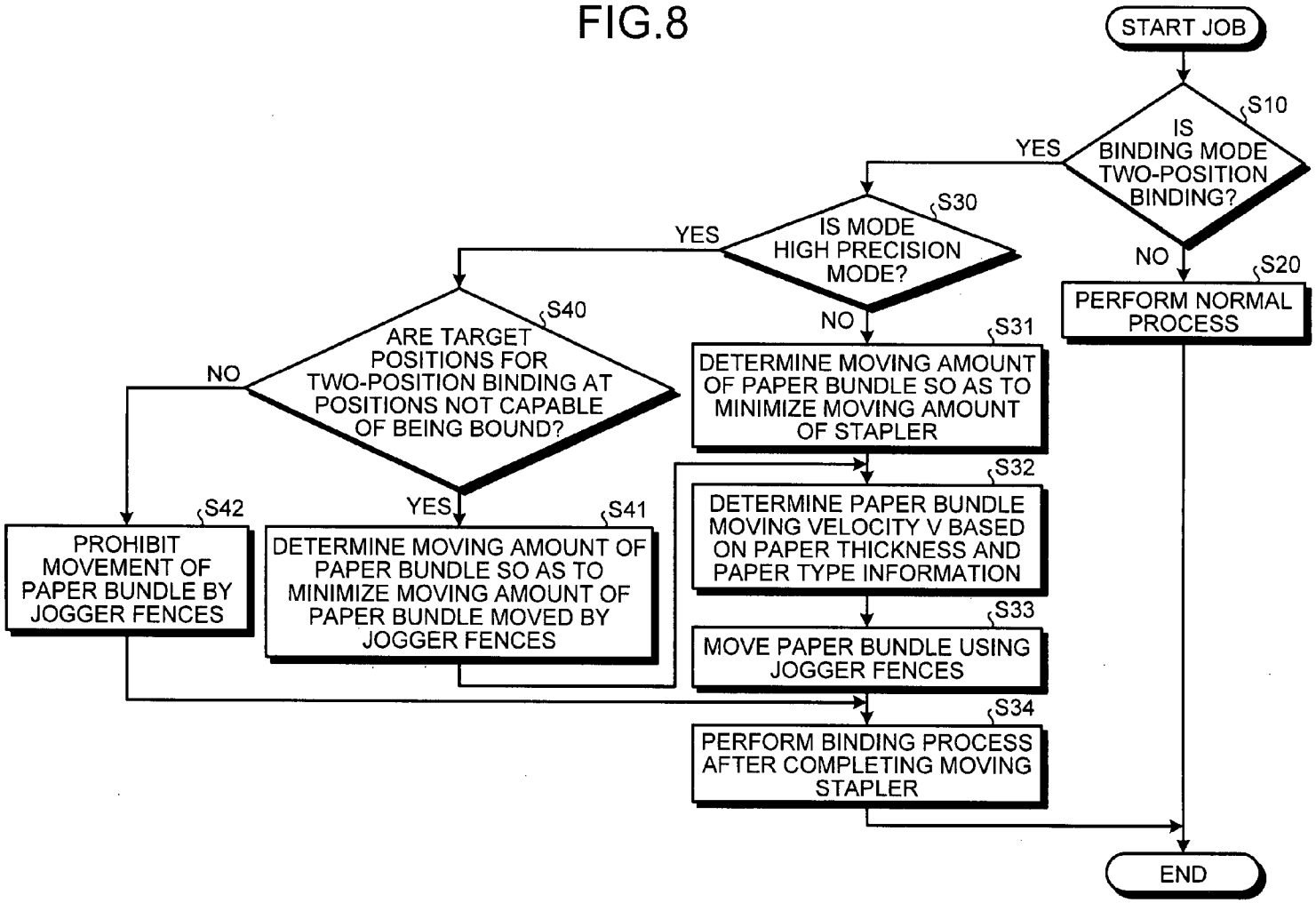
FIG. 8 is a flowchart of a binding process.

FIG. 8 is a flowchart of a binding process performed by the post-processing unit 200.

Upon starting a job, the post-processing unit 200 determines if the binding mode is two-position binding (S10). If the binding mode is not two-position binding, the post-processing unit 200 performs a normal process that is the same as the conventional binding process (S20), and the job is ended.

If the binding mode is the two-position binding, the post-processing unit 200 further determines if the mode is a high precision mode (S30). If the mode is not the high precision mode, the moving amount of the paper bundle P1 for minimizing the moving amount of the stapler S1 is determined so as to improve productivity (S31). When the paper bundle P1 is moved, the paper bundle P1 could become out of alignment more easily depending on the thickness or the type of a recording sheet P in the paper bundle P1. Therefore, the post-processing unit 200 determines a moving velocity V for the paper bundle P1 based on information about the thickness and the type of the paper (S32). Based on the moving amount and the moving velocity V of the paper bundle P1 thus determined, the two jogger fences 53 are caused to move in the sheet width direction so as to move the paper bundle P1 (S33). After completing moving the stapler S1, the binding process is performed (S34), and the job is ended.

On the contrary, if the mode is the high precision mode, the post-processing unit 200 determines if the target positions for the two-position binding are at positions where stapling cannot be performed without moving the paper bundle P1, because of factors such as a positional relationship of the stapler S1 with respect to other members (S40). If the target positions are at positions where stapling cannot be performed without moving the paper bundle P1, the post-processing unit 200 determines the moving amount of the paper bundle P1 for minimizing the amount by which the paper bundle P1 is moved by the jogger fences 53 (S41). The post-processing unit 200 then determines the moving velocity V (S32), moves the paper bundle P1 (S33), and performs the binding process (S34), and the job is ended.

If the mode is the high precision mode and the target positions are not at positions where stapling cannot be performed without moving the paper bundle P1, the post-processing unit 200 prohibits the jogger fences 53 from moving the paper bundle P1 (S42). The binding process is then performed by moving the stapler S1 without moving the paper bundle P1 (S34), and the job is ended.

To prioritize productivity, the sheet bundle is moved in advance using the jogger fences 53 to the positions where the moving amount of the stapler S1 is minimized upon moving the stapler S1 to the second target position on the paper bundle P1 (S31 and S33).

To prioritize precision, when the staple pitch used in the two-position binding is smaller than the minimum staple pitch, the jogger fences 53 is caused to move the paper bundle P1 so as to minimize the moving amount of the paper bundle P1 (S41). If the staple pitch used in the two-position binding is larger than the minimum staple pitch, the paper bundle P1 is not moved by the jogger fences 53 (S42), so that the alignment precision in the paper bundle P1 is not deteriorated by moving the paper bundle P1.

Furthermore, even when a precision is required, the alignment precision of the paper bundle P1 can be prevented from being deteriorated by setting the moving velocity of the paper bundle P1 carried by the jogger fences 53 to equal to or lower than a moving velocity V that is preset correspondingly to a paper thickness and a paper type.

The post-processing unit 200 according to the embodiment has a structure in which the jogger fences 53 are moved to move the paper bundle P1, thereby allowing the target positions on the paper bundle P1 to be set more freely. As a structure for allowing the target positions on the paper bundle P1 to be set more freely, it is only necessary for the structure to be able to move the paper bundle P1, and such a structure does not have to use the jogger fences 53 in moving the paper bundle P1. However, if the jogger fences 53, which are used for aligning the paper bundle P1 in the sheet width direction, are also used for moving the paper bundle P1, addition of a new moving mechanism is not required. In this manner, the paper bundle P1 can be moved without making the structure more complex and without increasing the costs.

Furthermore, the post-processing unit 200 according to the embodiment is explained to be a structure that processes a recording sheet P. However, as a sheet medium to be processed, it is not limited to paper, and the same process can be applied to different types of sheet media and a sheet bundle in which a plurality of such sheet media are stacked.

Furthermore, the post-processing unit 200 according to the embodiment is explained to perform two-position binding. However, this structure for adjusting the target positions on the sheet bundle by moving the sheet bundle can be applied even when the target position is one, or three or more.

Furthermore, in the embodiment, the sheet processing apparatus is explained to be the post-processing unit 200 that performs a post-process such as a binding process on a sheet medium having a surface on which an image is formed by the image forming apparatus. However, the sheet processing apparatus is not limited to the post-processing apparatus, and the structure adjusting the target positions on the sheet bundle by moving the sheet bundle can be applied to any sheet processing apparatus that performs a binding process on sheet media, such as a sheet processing apparatus independent from any image forming apparatus.

Furthermore, in the embodiment, the binding unit included in the sheet processing apparatus is explained to be the stapler S1. However, the binding unit is not limited to a stapler, and the structure for adjusting the target positions on the sheet bundle by moving the sheet bundle can be applied to any sheet processing apparatus including a binding unit other than a stapler, for example, those performing a binding process using a clip or a thread.

The post-processing unit 200 that is the sheet processing apparatus according to the embodiment includes pairs of rollers (including rollers 1, 2, 7, 9, 10 and 11) that are sheet conveying units that convey a recording sheet P that is a sheet medium, the binding tray F that is a sheet medium retaining unit in which a plurality of recording sheets P conveyed by the pairs of rollers are stacked and the recording sheets P are retained as a paper bundle P1, and the stapler S1 that is a binding unit that applies a binding process to the paper bundle P1 retained by the binding tray F. The post-processing unit 200 also includes the two jogger fences 53 functioning as a sheet bundle moving unit that moves the paper bundle P1 and displaces the position of the paper bundle P1 with respect to the stapler S1 so as to adjust the target positions on the paper bundle P1.

If the range where the stapler S1 can perform the clinching operation in the binding tray F is limited, the binding process cannot be applied to some positions of the paper bundle P1. By adjusting the target positions on the paper bundle P1 by displacing the position of the paper bundle P1 with respect to the stapler S1, the binding process can be applied to the positions that could not be bound by the conventional structure in which only the stapler S1 is moved. Therefore, by moving the paper bundle P1 to the position that can be clinched by the stapler S1, the binding process can be applied to any positions of the paper bundle P1, even when the range where the stapler S1 can perform the clinching operation on the binding tray F is limited.

In this manner, because the post-processing unit 200 according to the embodiment can apply the binding process to positions that could not be bound by the conventional sheet processing apparatus, the target positions on the sheet bundle can be specified more freely.

Furthermore, the post-processing unit 200 also includes a sheet bundle width direction aligning unit that aligns the paper bundle P1 in the sheet width direction by moving at least one of the jogger fences 53 that is a pair of width direction stopper members arranged facing each other across the paper bundle P1 along the sheet width direction that is perpendicular to the conveying direction of the recording sheet P in the paper bundle P1 retained by the binding tray F. The post-processing unit 200 also has a structure that causes the stapler S1 to perform the binding process on the paper bundle P1 aligned in the sheet width direction by the sheet bundle width direction aligning unit. The sheet bundle moving unit is realized by moving both of the jogger fences 53 in a pair in the same direction along the sheet width direction, as indicated by the arrows R in FIG. 1, so as to move the paper bundle P1 held therebetween. Upon aligning the paper bundle P1 using the jogger fences 53, the two jogger fences 53 perform reciprocal movements where the two jogger fences 53 are kept standby positions at a distance wider than the sheet width W, closed in the width direction upon receiving the recording sheet P, and returned to the positions where the space therebetween becomes larger than the sheet width W. Such a reciprocal movement is performed every time the binding tray F receives a recording sheet P so as to align the recording sheet P in the sheet width direction. After a predetermined number of recording sheets P is accumulated in the binding tray F, the binding process is performed on the recording sheets P being pressed by the trailing edge holding lever 110 by a certain amount. Upon adjusting the target positions by moving the paper bundle P1, the two jogger fences 53 are moved in the same direction, while the paper bundle P1 is held between the two jogger fences 53 closed to the sheet width W.

In such a structure that moves the paper bundle P1 using the jogger fences 53 for aligning the paper bundle P1 in the sheet width direction, addition of a new moving mechanism is not required. In this manner, the paper bundle P1 can be moved without making the structure more complex and without increasing the costs.

Furthermore, to adjust the target positions on the paper bundle P1, the post-processing unit 200 moves the stapler S1 to displace the position of the stapler S1 with respect to the paper bundle P1. In other words, the post-processing unit 200 does not simply move the paper bundle P1, but also is capable of moving both of the paper bundle P1 and the stapler S1 to adjust the target positions on the paper bundle P1. Upon performing control for not moving the paper bundle P1, the target positions on the paper bundle P1 can be adjusted by moving the stapler S1 only.

Furthermore, upon performing the binding process using a plurality of positions on the paper bundle P1 along the sheet width direction as the target positions, after the post-processing unit 200 performs the binding process on one of the target positions on the paper bundle P1 in the sheet width direction, the post-processing unit 200 moves the jogger fences 53 to move the paper bundle P1, so that the target position is moved to the other position on the paper bundle P1 along the sheet width direction. Therefore, it is possible to reduce the distance by which the stapler S1 is moved after performing the clinching operation at the first target position on the position facing the second target position. In this manner, the reduced productivity caused by performing the binding process can be alleviated.

Furthermore, in the post-processing unit 200, the distance by which and the moving velocity V at which the jogger fences 53 are moved so as to move the paper bundle P1 are variable. A higher moving velocity of the paper bundle P1 is more suitable for maintaining productivity. However, as the moving velocity becomes higher, the recording sheets P in the paper bundle P1 after the alignment can become out of alignment more easily. If the recording sheets P become out of alignment, the alignment precision of the paper bundle P1 is reduced. To consider the alignment precision of the paper bundle P1, it is preferable not to move the paper bundle P1 after being aligned, or to move the paper bundle P1 slowly if the paper bundle P1 has to be moved. On the contrary, to consider improvement in the productivity, it is preferable for the moving velocity to be higher, as mentioned above. Therefore, when the productivity is prioritized, the moving amount of the paper bundle P1 is set large, and the moving velocity V of the paper bundle P1 is set high. On the contrary, when the alignment precision is prioritized, the moving amount of the paper bundle P1 is set to the minimum or none, and if the paper bundle P1 has to be moved, the moving velocity V is set so as to move the paper bundle P1 slowly by the required moving amount. In this manner, a post-process meeting these demands can be realized by changing the distance and the moving velocity V by and at which the paper bundle P1 is moved depending on whether the productivity or the alignment precision is prioritized.

Furthermore, in the post-processing unit 200, the moving velocity V for moving the jogger fences 53 can be set in a variable manner depending on the type and the thickness of the sheet medium. When an aligned sheet bundle is moved, the sheet bundle can be out of alignment by a different degree depending on the type or the thickness of the sheet medium to be processed. For example, when coated paper is used as an example of the paper type, because the surface is very smooth, sheets can move easily relatively to each other, and the alignment precision can easily be reduced by moving the sheet bundle. When this type of paper is used, the moving velocity V is set low. On the contrary, when paper having a less smooth surface that is also called coarse paper is used, sheets hardly move relatively to each other, and the alignment precision cannot be easily reduced by moving the sheet bundle. When this type of paper is used, the moving velocity V is set high.

However, it is not always possible to determine which types of paper move easily or hardly relatively to each other. Therefore, the post-processing unit 200 is input with data about the relationship between the paper type and easiness of sheets moving relatively to each other obtained by experiments for each paper type in advance, and changes the moving velocity based on the relationship between the specified paper type and the data.

Furthermore, the paper type is not limited to standard paper that is generally used. It is preferable for the moving velocity to be changed based on information about types of so-called special paper, such as paper applied with special surface coating, e.g., coated paper or matt coated paper.

Furthermore, with regard to the thickness of a sheet medium, it is possible to think that thick sheets will not move easily relatively to each other because the thick sheets are heavy. At the same time, it is also possible to think that thin sheets will not move easily relatively to each other with a large frictional force because thin sheets could be bent more easily. Therefore, experiments are conducted using different types and thicknesses of paper, and data based on the result is input to the post-processing unit 200 in advance, so that the velocity can be changed based on the data.

Some factors causing the sheets in a paper bundle to move easily relatively to each other include stiffness of the sheets, directions of the grains on the surface, and sizes.

Furthermore, the image forming apparatus 600 according to the embodiment includes the image forming unit 300 that is an image forming unit that forms an image on the recording sheet P that is a sheet-like recording medium, the post-processing unit that performs a post-process such as a binding process on the recording sheet P on which an image is formed by the image forming unit 300, and uses the post-processing unit 200 described above as the post-processing unit. Therefore, the target positions on the paper bundle P1 of the recording sheets P on which images are formed can be set more freely.

According to the present invention, because target positions on a sheet bundle are adjusted by displacing the position of the sheet bundle with respect to the binding unit, the binding process can be applied to positions that could not be bound by a conventional structure in which only the binding unit is moved.

According to the present invention, because the binding process can be applied to positions that could not be bound by the conventional sheet processing apparatus, target positions on a sheet bundle can be specified more freely, advantageously.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus comprising:

a sheet conveying unit configured to convey a sheet medium;

a sheet medium retaining unit configured to stack a plurality of sheet media conveyed by the sheet conveying unit and to retain the sheet media as a sheet bundle;

a binding unit configured to perform a binding process on the sheet bundle retained by the sheet medium retaining unit;

a sheet bundle moving unit configured to move the sheet bundle so as to displace the sheet bundle with respect to the binding unit;

a binding moving unit configured to displace the binding unit with respect to the sheet bundle; and a processing unit configured to, determine a first movement distance for the binding unit, determine a second movement distance for the sheet bundle moving unit, the first and second movement distances being variable based on a selected processing mode, and instruct the binding moving unit and the sheet bundle moving unit to move the binding unit and the sheet bundle by the first and second movement distances, respectively, wherein the processing unit is configured to instruct the binding moving unit and the sheet bundle moving unit to move the binding unit and the sheet bundle respectively, when a sum of the first movement distance for the binding unit and the second movement distance for the bundle moving unit is greater than a distance that the binding unit is able to move, and the processing unit is configured to instruct the binding moving unit to move the binding unit and to instruct the sheet bundle moving unit not to move the sheet bundle when the sum of the first and second movement distances is not larger than the distance that the binding unit is able to move.

2. The sheet processing apparatus according to claim 1, wherein, upon performing the binding process on a plurality of target positions on the sheet bundle along a sheet width direction, the binding process is performed on a target position on the sheet bundle along the sheet width direction, and the sheet bundle is then moved by the sheet bundle moving unit to other target position on the sheet bundle along the sheet width direction.

3. The sheet processing apparatus according to claim 1, wherein a distance by which a moving velocity at which the sheet bundle moving unit moves the sheet bundle is variable.

4. The sheet processing apparatus according to claim 3, wherein the velocity at which the sheet bundle moving unit moves the sheet bundle is varied depending on a type of the sheet medium.

5. The sheet processing apparatus according to claim 3, wherein the velocity at which the sheet bundle moving unit moves the sheet bundle is varied depending on a thickness of the sheet medium.

6. An image forming apparatus comprising:

the sheet processing apparatus of claim 1.

* * * * *